US005808585A

United States Patent [19]

Frenzer et al.

[11] Patent Number: 5,808,585

[45] Date of Patent: Sep. 15, 1998

[54] METHOD OF CONFIGURING MULTIPLE-ARM ANTENNA ELEMENT IN A RADOME

[75] Inventors: Michael William Frenzer, Palatine; Christopher Neil Kurby, Elmhurst, both of Ill.; Kevin Michael Thill, Kenosha, Wis.

[73] Assignee: Motorola, Inc., Schaumburg, Ill.

[21] Appl. No.: 921,790

[22] Filed: Sep. 2, 1997

Related U.S. Application Data

[63] Continuation of Ser. No. 414,151, Mar. 31, 1995, abandoned.

[51] Int. Cl.[6] ..... H01Q 1/42

[52] U.S. Cl. ..... 343/872; 343/895

[58] Field of Search ..... 343/872, 873, 343/895; H01Q 1/42, 1/36

[56] References Cited

U.S. PATENT DOCUMENTS 2,919,442 12/1959 Nussbaum ..... 343/895
3,617,890 11/1971 Kurauchi et al. ..... 343/895
3,828,353 8/1974 Majkrzak et al. ..... 343/895

FOREIGN PATENT DOCUMENTS 63-100387 5/1988 Japan ..... 343/873

OTHER PUBLICATIONS

A. Kumar, *Fixed and Mobile Terminal Antennas,* in Chapter 5, Figure 5.9 (a) on p. 189, Artech House, Inc., 1991.

*Primary Examiner*—Michael C. Wimer
*Attorney, Agent, or Firm*—Richard K. Clark; Rolland R. Hackbart

[57] ABSTRACT

A radome (310) made of a cylindrical tube sealed on a first end and open on a second end houses a multiple-arm antenna element (405). The radome is formed with at least two grooves (340, 350) on an inner surface of the cylindrical tube for meshing with arms (410, 420, 430, 440) of the multiple-arm antenna element (405).

3 Claims, 4 Drawing Sheets

METHOD OF CONFIGURING MULTIPLE-ARM ANTENNA ELEMENT IN A RADOME

This is a continuation of application Ser. No. 08/414,151, filed Mar. 31, 1995 and now abandoned.

BACKGROUND OF THE INVENTION

1. Technical Field of the Invention

The invention is directed towards radomes and, more particularly, is directed towards radomes for housing an antenna element.

2. Description of the Related Art

Many antennas have antenna elements housed inside a radome. The radome is attached to a fixture supporting the antenna. The radome protects the relatively fragile transducive element from damage due to environmental conditions such as vibration or shock during use. Foam pads have been placed between the radome and flat conductive portions of the antenna. Added components such as foam pads complicate assembly, add cost and increase size of the overall radome structure. A radome is needed with increased durability and with reduced cost and size.

A typical multiple-arm antenna element made of wire is a crossed loop or quadrifilar helix antenna element. In a crossed loop or quadrifilar helix antenna element, a pair of arms forms a loop and two loops are crossed at 90 degrees. Known crossed loop and quadrifilar helix antenna elements typically have two crossed loops of different lengths for self phasing of the antenna element. The overall construction of a quadrifilar helix or crossed loop antenna element is known to those of skill in the art.

The size of antenna elements has been reduced in the art by narrowing or shortening the overall dimensions of an antenna. Creating a smaller looking antenna by reducing the antenna's dimensions reduces the antenna's gain by a few or more decibels. In a device such as a low-power, portable satellite transceiver for communicating with non-geosynchronus satellites, a uniform and low-loss antenna gain pattern is important. Small size, particularly in diameter, is also desired to improve portability and user desirability. The present invention reduces antenna size while maintaining a desired gain pattern not heretofore possible.

Antenna elements having multiple arms are also difficult to manufacture with accuracy. Special fixtures are needed during the manufacturing process when soldering arms together to form the antenna element. The arms must be perfectly dimensioned to provide an ideal gain pattern with minimum loss. Further, techniques for improving the accuracy of assembly of multiple-armed antenna elements are desired. Techniques for reducing or eliminating special fixtures during assembly of multiple-armed antenna elements are additionally needed.

DETAILED DESCRIPTION OF THE PREFERRED EMBODIMENTS

Figure 1:
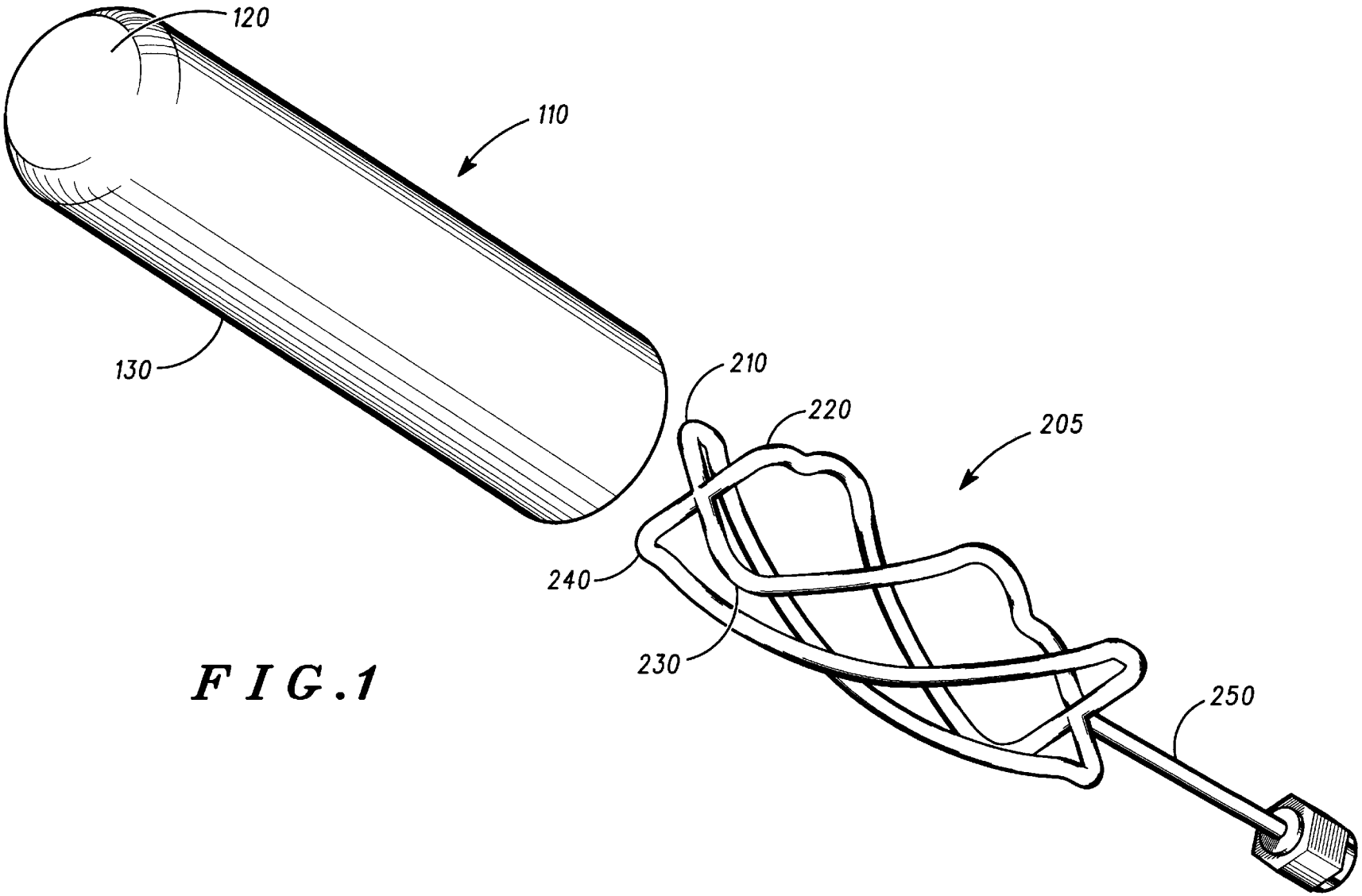
FIG. 1 illustrates a radome for housing an antenna element according to the present invention.

FIG. 1 illustrates a radome 110 for housing a multiple-arm antenna element 205. The multiple-arm antenna element 205 has arms 210, 220, 230 and 240, and has a feed 250. The arms 210, 220, 230 and 240 are transducive arms because they can either transmit or receive electromagnetic energy depending on application. The feed 250 brings signals corresponding to the electromagnetic energy to and from the transducive arms. Feed 250 preferably is made of a coaxial structure to avoid direct radiation therefrom. The radome 110 covers the exterior of the antenna element 205 to physically house the delicate structures of the transducive arms 210, 220, 230 and 240. To reduce an overall cross-sectional diameter of a final antenna structure, the radome 110 has as small a diameter as practical.

The antenna element 205 illustrated in the example of FIG. 1 is a quadrifilar helix antenna element. The four transducive arms 210, 220, 230 and 240 of a quadrifilar helix antenna element form two loops. Each loop is formed by a pair of the transducive arms. The two loops are crossed with respect to one another and helically twisted.

The radome 110 in the example of FIG. 1 is made of a continuous solid piece of material. The radome 110 could alternatively have a separate end cap 120 attached to a cylindrical tube 130.

The radome 110 of the present invention is formed with at least two grooves on an inner surface of the cylindrical tube 130 for meshing with the transducive arms. By forming grooves on an inner surface of the cylindrical tube 130, a smaller size, particularly in diameter, is provided to improve portability and user desirability. The grooves on the inner surface of the cylindrical tube 130 also shape the transducive arms 210, 220, 230 and 240 of the antenna element 205. Special fixtures used to form the transducive arms in an ideal shape are thus minimized. During manufacture, the transducive arms of the antenna element can be press fit, slid into or screwed into the grooves of the radome. When the transducive arms are placed in the grooves of the radome, the arms are shaped in a fixed, predetermined location. Therefore, shaping accuracy of the antenna elements themselves during manufacture of the transducive arms is less critical because the grooves in the radome 110 shape the transducive arms.

The grooves on the inside surface of the radome 110 also support delicate structures of the antenna element 205. The present invention avoids movement of the transducive arms 210, 220, 230 and 240 should the radome be shaken or dropped. The present invention also avoids costly alternative solutions such as foam pads placed between the antenna element 205 and the radome 110. Additional elements such as, for example, these foam pads complicate assembly, add cost and increase size of the overall radome structure. The present invention allows for shaping and supporting of transducive arms of an antenna element while increasing durability and reducing cost and size.

Figure 2:
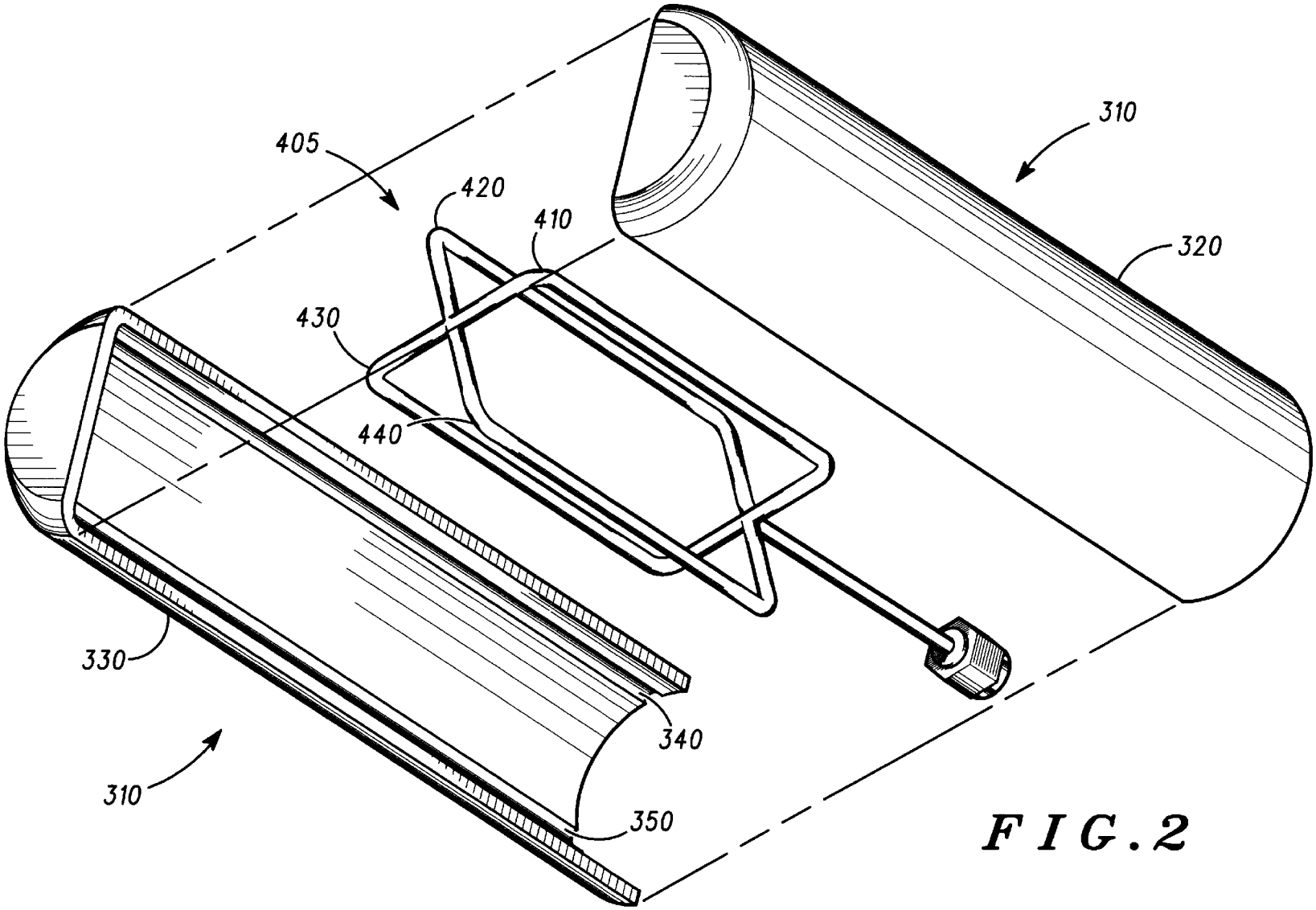
FIG. 2 illustrates a radome for housing another antenna element according to the present invention.

FIG. 2 illustrates a radome 310 for housing another antenna element 405 according to the present invention. The radome 310 of FIG. 2 has two sides 320 and 330. Making the radome 310 out of the two sides 320 and 330 can facilitate assembly of the antenna element 405 inside of the radome. Grooves 340 and 350 are formed in the sides 320 and 330 of the radome 310.

The grooves 340 and 350 in the example of FIG. 2 are straight grooves corresponding to the straight arms 410, 420, 430 and 440 of a crossed loop antenna element 405. The crossed loop antenna element 405 of the example of FIG. 2 is an alternative configuration of an antenna element similar in structure to the quadrifilar helix of FIG. 1 without the helical twist.

Figure 3:
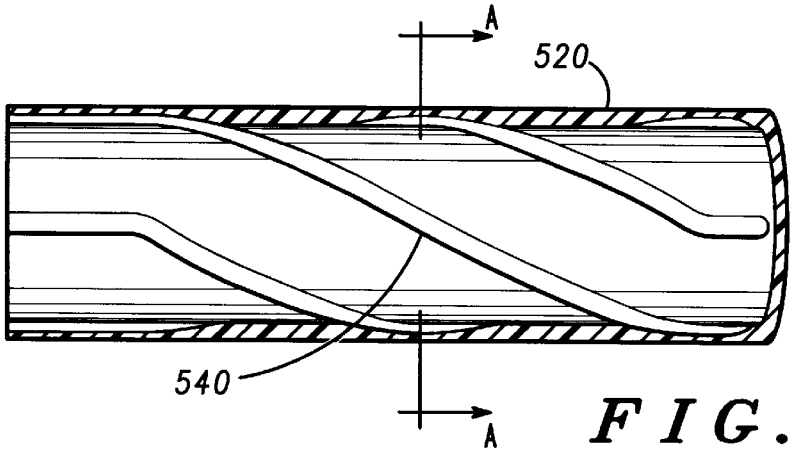
FIG. 3 illustrates one side of a radome for housing the antenna element according to the present invention.

FIG. 3 illustrates one side of a radome 520 in an example of an alternative embodiment having angled grooves 540. The grooves 540 are angled rather than straight such as those shown in the example of FIG. 2. The angled grooves 540 mesh with the helical twist of the transducive arms of a quadrifilar helix antenna element. Should a straight-armed antenna element such as the crossed loop antenna element of FIG. 2 be used, then straight grooves rather than angled grooves are preferred on the inner surface of the radome.

FIGS. 4–7 illustrate alternative embodiments of cross-sections of a whole radome structure along the line A illustrated in FIG. 3. Various embodiments of the grooves in the radome for meshing the transducive arms of an antenna element are shown.

Figure 4:
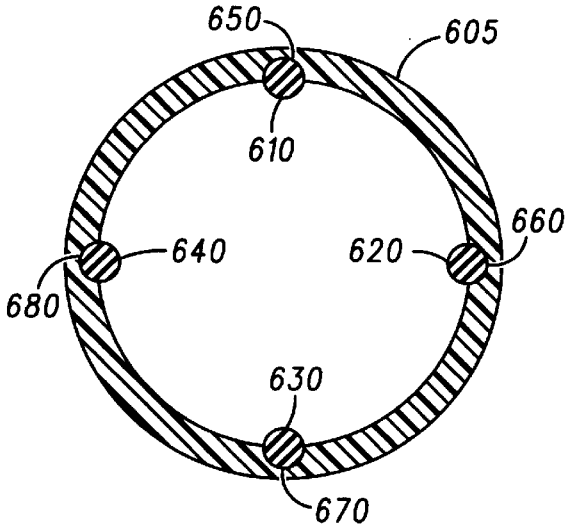
FIGS. 4, 5, 6 and 7 illustrate cross sections of embodiments of the radome according to the present invention.

FIG. 4 illustrates a cross-section of a radome 605 having grooves 650, 660, 670 and 680 formed inside of an inner surface of the radome 605. The grooves 650, 660, 670 and 680 mesh with the transducive arms 610, 620, 630 and 640. In the embodiment of FIG. 4, the radome 605 is shaped as an ideal circle and the grooves 650, 660, 670 and 680 protrude into the material of the cylindrical tube of the radome 605.

Figure 5:
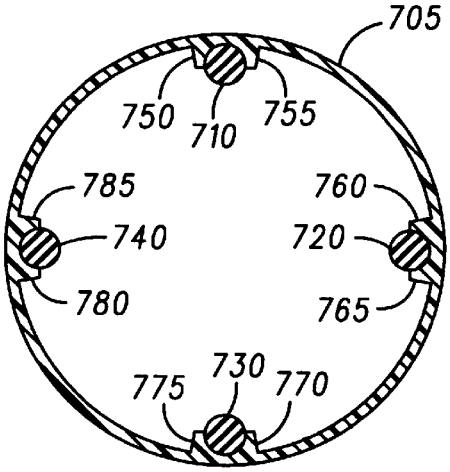

FIG. 5 illustrates a cross-section of a radome 705. In the embodiment of FIG. 5, transducive arms 710, 720, 730 and 740 mesh with grooves formed between pairs of protrusions 750, 755, 760, 765, 770, 775, 780 and 785. For example, a transducive arm 710 lies in a groove between the pair of the protrusions 750 and 755. By providing a groove between pairs of protrusions on an inside surface of the radome 705, the thickness between the groove and the outside of the radome can be the same as the thickness of the entire cylindrical tube forming the radome. In contrast, the grooves of FIG. 4 are recessed into the cylindrical tube of the radome; consequently, the radome shell has a thinner diameter below each of the grooves of the exemplary embodiment of FIG. 4.

The protrusions 750, 755, 760, 765, 770, 775, 780 and 785 preferably are integrally-formed in the material of the cylindrical tube of the radome 705. The protrusions and radome can be made of the same type of material. A type of material for the radome having hard and lightweight properties is preferred, such as, for example, rigid plastic. Plastic material often used in injection-molded processes is often preferred. The protrusions and cylindrical tube of the radome can thus be integrally-formed in one injection molding process to save cost, reduce parts and provide a more structurally sound one piece member.

Figure 6:
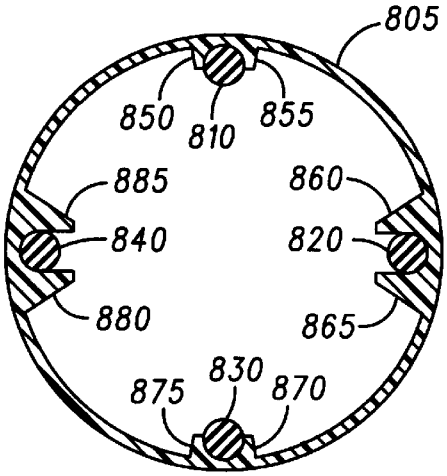

FIG. 6 illustrates a cross section of a radome 805 having grooves meshing with arms 810, 820, 830 and 840 lying between pairs of protrusions 850, 855, 860, 865, 870, 875, 880 and 885. In the embodiment of FIG. 6, protrusions 860, 865, 880 and 885 are heavier or larger than protrusions 850, 855, 870 and 875. By making some of the protrusions heavier than other of the protrusions, the transducive arms of an antenna element can be loaded differently by the dielectric material of the protrusions.

The heavier protrusions can be used to adjust electromagnetic properties of the transducive arms of the antenna element. Materials in close proximity to a transducive arm affect the transducive properties of the arm. The amount of impact a material in close proximity to a transducive arm has depends on the type of material, the proximity of the material to the transducive arm, the position along a length of the arm and the amount of material. By using heavier protrusions 860 and 865 for the transducive arm 820 than the protrusions 850 and 855 used for the transducive arm 810, the transducive arm 820 will be given different transducive characteristics than the transducive arm 810. Such different characteristics on some transducive arms can be used to reduce the size of, for example, one of the loops of a quadrifilar helix or crossed loop antenna element. Typical self phased quadrifilar helix antenna elements and self phased crossed loop antenna elements have one loop larger than another. When one loop is larger than another, the radome would require an oval cross-sectional shape rather than circular cross-sectional shape. Or an oversized circular cross-sectional shape can be used. Using the heavier protrusions, a quadrifilar helix antenna element or a crossed loop antenna element can have two crossed loops of the same size. When one of these same size loops has the heavier protrusions, it becomes more inductive than the other loop. Thus when both loops are capacitive without the heavier protrusions, adding the heavier protrusions to one loop makes the one loop inductive. When an appropriate amount of heaviness is added in a position, the capacitive and inductive components will cancel and the antenna element will appear purely resistive. Self phasing of the antenna element at the resonant frequency is thus achieved. By providing heavier protrusions near some arms, the shape of the antenna element, and thus the radome, can be altered while maintaining the desired electromagnetic characteristics of the antenna element.

Figure 7:
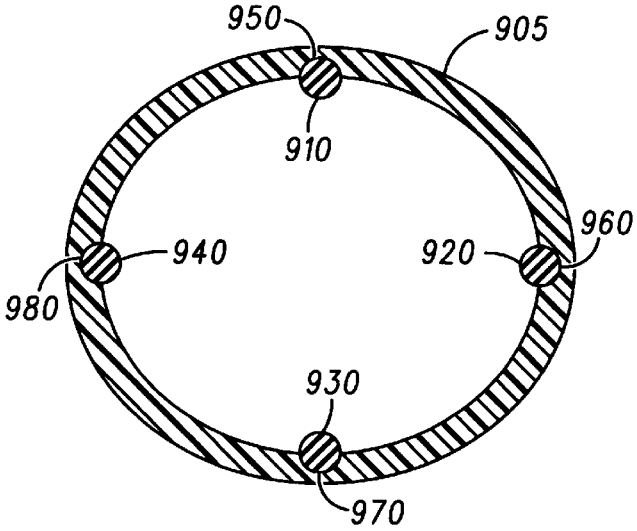

FIG. 7 illustrates a cross-section of a radome 905 having grooves 950, 960, 970 and 980 to accommodate transducive arms 910, 920, 930 and 940 according to another embodiment of the present invention. In FIG. 7, the radome has an oval-shaped inner and outer surface to accommodate an antenna element such as a quadrifilar helix or closed-loop antenna having one of the two loops larger than the other. The oval shape of FIG. 7 can also accommodate grooves formed between pairs of protrusions rather than grooves formed inside a cylindrical tube of the radome. Such an embodiment could be used, for example, for a quadrifilar helix on crossed loop antenna element without the heavier protrusions of the embodiment of FIG. 6, for example.

Figure 8:
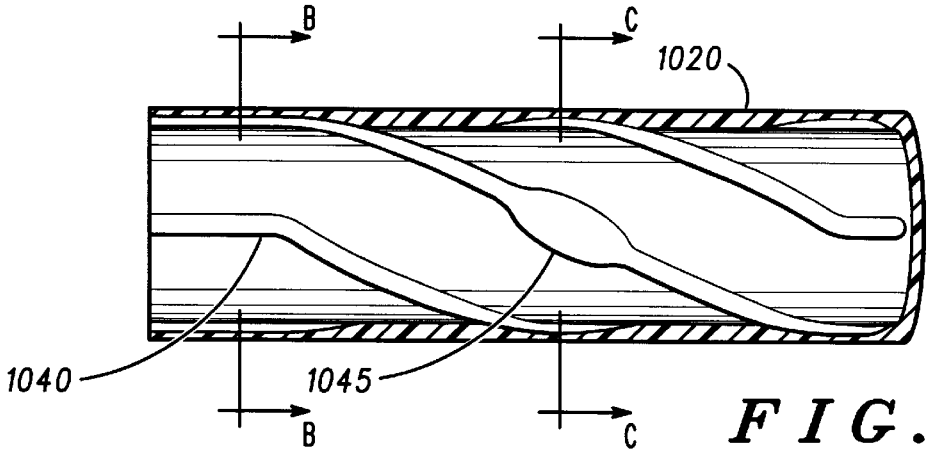
FIG. 8 illustrates one side of a radome for housing the antenna element according to the present invention.

FIG. 8 illustrates one side of a radome 1020 in an example of other embodiments according to the present invention. Angled grooves 1040 and 1045 are illustrated on an inner surface of the radome 1020. In FIG. 8, the grooves 1045 at a mid-section are different. As illustrated in FIG. 8, the groove 1045 is larger near the midsection of the length of the cylindrical tube of the radome. The grooves formed by the heavier protrusions do not need to be positioned against an entirety of the transducive arm. Instead, the heavier protrusions can be positioned along only a portion of a length of the cylindrical tube such as, for example, the mid-section. Thus, besides that illustrated in FIG. 8, the grooves at the midsection can contain the heavier protrusions of, for example, FIG. 6. For example, cross-section B of FIG. 8 can correspond to the cross-section in FIG. 5 and cross-section C in FIG. 8 can correspond to the cross-section of FIG. 6. Alternatively, the cross-section B can correspond to FIG. 4 and the cross-section C can correspond to either of FIG. 9 or FIG. 10.

Figure 9:
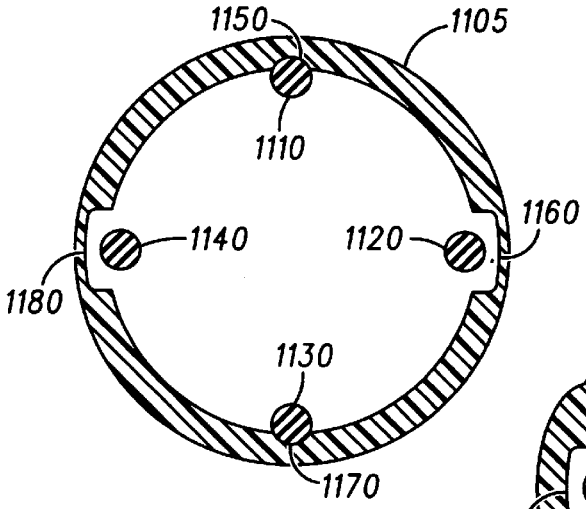
FIGS. 9, 10 and 11 illustrate cross sections of embodiments of the radome according to the present invention.

FIG. 9 illustrates a cross-section of a radome 1105 having grooves 1150 and 1170 meshing with transducive arms 1110 and 1130 and having hollow portions 1160 and 1180 surrounding transducive arms 1120 and 1140. These hollow portions 1160 and 1180 have a larger dimension. The hollow portions 1160 and 1180 preferably are only at a mid-section of the cylindrical tube of the radome 1105 so that the transducive arms 1120 and 1140 are held in place. The hollow portions 1160 and 1180 expose the transducive arms 1120 and 1140 to less material, thus altering the electromagnetic characteristics of the associated transducive arms. Because the type of material and the proximity and amount of material affect the electromagnetic characteristic of an arm, taking away material by creating the hollow portions allows adjustment of electromagnetic characteristics as does adding material to create a heavier protrusion in alternative embodiments. Additionally, the closer a material to a mid-section along a length of an arm, the stronger an impact on the electromagnetic characteristics of the arm in a quadrifilar helix antenna element.

Figure 10:
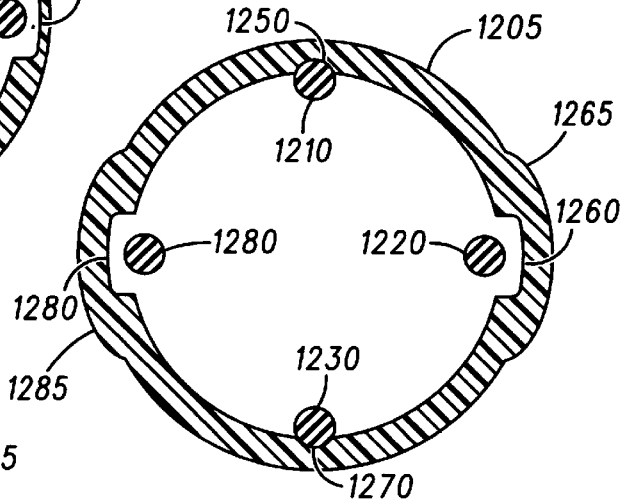

FIG. 10 illustrates a cross-section a radome 1205. In the embodiment of FIG. 10, grooves 1250 and 1270 mesh with transducive arms 1210 and 1230. Hollow portions 1260 and 1280 surround transducive arms 1220 and 1240. However, in contrast with the embodiment of FIG. 9, the embodiment of FIG. 10 has bulges 1265 and 1285 surrounding the hollow portions 1260 and 1280. The bulges 1265 and 1285 provide added structural strength to the cylindrical tube of the radome 1205. In the embodiment of FIG. 9, the cylindrical tube of the radome 1105 becomes thinner at an outside edge of the hollow portions. Providing the bulges of FIG. 10 helps create a more uniform thickness throughout the cylindrical tube of the radome 1205.

The protrusions or hollow portions or the present invention can vary at a middle portion, can vary at an end portion or can be provided throughout the grooves extending along the cylindrical tube of the radome of the present invention. Placing the hollow portion in the middle is preferred so that the ends of an arm are still secured in a groove. The protrusions, however, can be placed anywhere along the cylindrical tube and still fully secure an arm.

Figure 11:
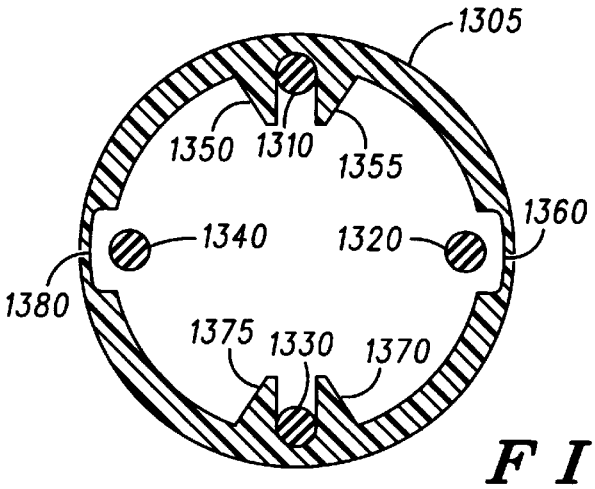

FIG. 11 illustrates a further alternative embodiment of the present invention having both protrusions 1350, 1355, 1370 and 1375 and hollow portions 1360 and 1380. A combination of protrusions and hollow portions can be used to alter electromagnetic characteristics of the transducive arms.

The grooves or pairs of protrusions preferably touch the arms to mechanically support the antenna element. Nevertheless, the portions of the grooves on some of the protrusions can be adjacent to the antenna element without touching the transducive arms. Placing the heavier protrusions adjacent to the arms without touching will still alter electromagnetic characteristics of the arms but avoids the advantages of mechanical support.

Although the invention has been described and illustrated in the above description and drawings, it is understood that this description is by example only, and that numerous changes and modifications can be made by those skilled in the art without departing from the true spirit and scope of the invention. Although the above drawings depict only one antenna element, an array of antenna elements can be implemented in an antenna. The present invention is not limited to portable electronic radios such as radiotelephones and pagers but can be applied to other devices such as ground stations, fixed satellite telephone booths, and aircraft and marine stations. The radome of the present invention is not transmission frequency limited. Further, the principles of the present invention are applicable to satellite as well as terrestrial based communications.

What is claimed is:

1. A method of configuring a multiple-arm antenna element in a radome, said multiple-arm antenna element having at least two transducive arms, said method comprising the steps of:

(a) providing a radome comprising a cylindrical tube with at least two preformed grooves in a predetermined configuration on an inner surface of said cylindrical tube, wherein the preformed grooves lie between protrusions formed on the inner surface of said cylindrical tube, each said groove formed between pairs of the protrusions, and wherein one of said pairs of protrusions is heavier than another of said pairs of protrusions to alter electromagnetic characteristics of an associated transducive arm; and thereafter (b) fixing, inside of the cylindrical tube of the radome, the multiple-arm antenna element between the preformed grooves on the inner surface of said cylindrical tube, wherein said preformed grooves shape the transducive arms in the predetermined configuration.

2. A method of configuring a multiple-arm antenna element in a radome, said multiple-arm antenna element having at least two transducive arms, said method comprising the steps of:

(a) providing a radome comprising a cylindrical tube with at least two preformed grooves in a predetermined configuration on an inner surface of said cylindrical tube, wherein said preformed grooves have a dimension and extend along a length of said cylindrical tube, at least one of said preformed grooves having a dimension that changes along the length of said cylindrical tube; and thereafter (b) fixing, inside of the cylindrical tube of the radome, the multiple-arm antenna element between the preformed grooves on the inner surface of said cylindrical tube, wherein said preformed grooves shape the transducive arms in the predetermined configuration.

3. A method of configuring a multiple-arm antenna element in a radome according to claim 2, wherein said step (a) further comprises the substep of (a1) providing the radome wherein the at least one preformed groove having a dimension that changes along the length of said cylindrical tube has a larger dimension near a midsection of the length of said cylindrical tube.

* * * * *